US008327812B2

(12) United States Patent
Vuk

(10) Patent No.: US 8,327,812 B2
(45) Date of Patent: Dec. 11, 2012

(54) NUCLEATE BOILING COOLING SYSTEM

(75) Inventor: Carl T. Vuk, Denver, IA (US)

(73) Assignee: Deere & Company, Moline, IL (US)

( * ) Notice: Subject to any disclaimer, the term of this patent is extended or adjusted under 35 U.S.C. 154(b) by 669 days.

(21) Appl. No.: 12/508,674

(22) Filed: Jul. 24, 2009

(65) Prior Publication Data

US 2011/0017154 A1 Jan. 27, 2011

(51) Int. Cl.
*F01P 3/22* (2006.01)

(52) U.S. Cl. ..... 123/41.54; 123/41.02

(58) Field of Classification Search ..... 123/41.01, 123/41.02, 41.1, 41.09, 41.54, 41.44, 41.21, 123/41.51; 60/730
See application file for complete search history.

(56) References Cited

U.S. PATENT DOCUMENTS

| | | | | |
|---|---|---|---|---|
| 3,177,656 | A * | 4/1965 | Tick et al. | 60/206 |
| 3,347,057 | A * | 10/1967 | Van Wanderham et al. | 62/56 |
| 4,367,699 | A * | 1/1983 | Evans | 123/41.23 |
| 4,381,736 | A * | 5/1983 | Hirayama | 123/41.1 |
| 4,539,942 | A * | 9/1985 | Kobayashi et al. | 123/41.1 |
| 4,557,223 | A * | 12/1985 | Gueyen | 123/41.12 |
| 4,630,572 | A * | 12/1986 | Evans | 123/41.21 |
| 4,662,317 | A | 5/1987 | Ogawa | |
| 4,768,484 | A * | 9/1988 | Scarselletta | 123/41.21 |
| 5,031,579 | A * | 7/1991 | Evans | 123/41.2 |
| 5,723,773 | A | 3/1998 | Bryan | |
| 6,053,132 | A * | 4/2000 | Evans | 123/41.5 |
| 6,247,429 | B1 | 6/2001 | Hara et al. | |
| 6,502,655 | B2 | 1/2003 | Peddycord et al. | |
| 6,789,512 | B2 * | 9/2004 | Duvinage et al. | 123/41.05 |
| 6,955,141 | B2 | 10/2005 | Santanam et al. | |
| 7,069,883 | B2 | 7/2006 | Atkins | |
| 7,258,083 | B2 | 8/2007 | Lindsey | |
| 7,331,190 | B2 | 2/2008 | Garner et al. | |
| 2005/0028756 | A1 | 2/2005 | Santanam et al. | |

FOREIGN PATENT DOCUMENTS

| | | |
|---|---|---|
| EP | 0182340 | 4/1991 |
| WO | 0070209 A1 | 11/2000 |

OTHER PUBLICATIONS

U.S. Appl. No. 12/136,197, filed Jun. 10, 2008, entitled "Nucleate Boiling Cooling System and Method".

Andrew T. O'Neill. Experimental Determination of Convection Boiling Curves for Water and Ethylene Glycol in a Rectangular Channel with Localized Heating, Mar. 23, 2005.

* cited by examiner

*Primary Examiner* — Noah Kamen
*Assistant Examiner* — Long T Tran
(74) *Attorney, Agent, or Firm* — Taylor IP, P.C.

(57) ABSTRACT

A cooling system for a liquid cooled internal combustion engine having coolant passages and a heat exchanger selected to operate the engine cooling system in the region of nucleate boiling. A sensor detects the presence of nucleate boiling and a variable volume chamber has a flexible diaphragm urged on one side by controlled air pressure and responsive to the sensor maintain the coolant system pressure at a level maintaining optimum nucleate boiling to increase heat flux from the engine and reduce overall size of the system.

20 Claims, 1 Drawing Sheet

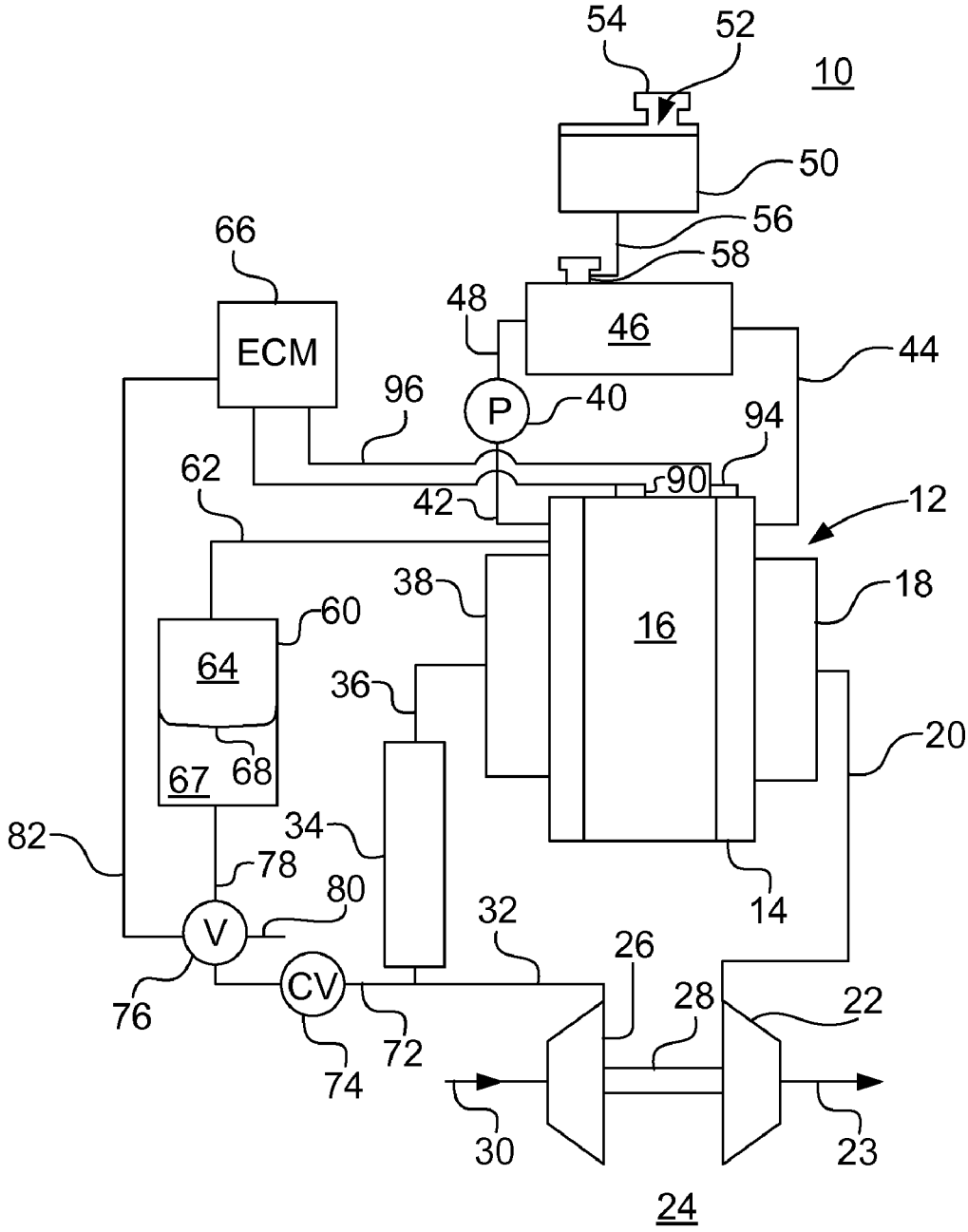
54
52
10
50
56
58
66
ECM
48
46
44
96
P
40
94
62
90
42
12
38
18
60
16
64
36
20
67
68
82
34
78
80
14
32
V
26
CV
28
22
76
72
74
30
23
24

NUCLEATE BOILING COOLING SYSTEM

FIELD OF THE INVENTION

The present invention relates to internal combustion engine systems and more specifically to coolant systems and methods for such systems.

BACKGROUND OF THE INVENTION

One of the principle sources of parasitic losses, complications and bulk in an internal combustion engine has to do with the waste heat generated by the internal combustion engine process. Attempts have been made to manage heat flux from the material surrounding combustion chambers by paying careful attention to flow passages, coolant flow rates and temperatures through such passages. Typically, internal combustion engines are liquid cooled so as to maximize the heat flux to the cooling system, particularly in the region closely adjacent the combustion chamber. When cooling systems operate under off design conditions because of duty cycle or component malfunction, it can lead to a condition of uncontrolled boiling in the coolant passages for the engine. This condition causes complete loss of liquid to metal contact and drastically reduces the heat flux carried away by the cooling system. When this is left uncontrolled, the pressure relief for the system, usually a radiator cap, is opened to release pressure and allow even greater generation of steam. This, in turn, has a potentially catastrophic affect on the temperature of the internal metal parts of the engine.

There is, however, a condition between normal liquid flow conditions and uncontrolled boiling that provides an optimum heat flux from the parts to be cooled by the liquid cooling system. This is known as nucleate boiling in which bubbles are generated on a microscopic scale. This allows significant increases in heat flux, but this condition, at best, is a momentary transition between sub-boiling conditions and uncontrolled or macro-boiling.

It has been proposed in copending application Ser. No. 12/136,197, filed on Jun. 10, 2008, of common assignment with the present invention, to provide active control of the pressure within the cooling system of an internal combustion engine. This is done with a sensor and a device to increase or decrease, on a rapid basis, the system pressure so as to maintain nucleate boiling and the optimum heat flux. One example of such a device is a second pump activated to increase pressure. Such a system, while effective in maintaining conditions of nucleate boiling, has additional complications and complexity which increases the cost of such a system for an internal combustion system.

What is needed in the art therefore is a cost effective system for controlling pressure to produce nucleate boiling.

SUMMARY OF THE INVENTION

In one form, the invention is a cooling system for a liquid cooled internal combustion engine. The engine includes coolant passages formed at least around a combustion chamber for the engine. A heat exchange device is fluidly connected to the passages for dissipating heat from at least around the combustion chamber. A pump is provided for circulating coolant through the passages and the heat exchanger with the coolant passage, heat exchange device, the pump being selected to cause nucleate boiling at least around the combustion chamber. A sensor is provided for indicating the presence of nucleate boiling in the system. At least one chamber is connected to the cooling system with the chamber having a dividing wall movable within the chamber to vary the volume of the chamber connected to the cooling system. A device is provided for variably displacing the dividing wall in response to control by the sensor to maintain the pressure in the system at a level permitting controlled nucleate boiling to increase the heat flux from at least around the combustion chamber.

In another form, the invention is a power system including a liquid cooled internal combustion engine having at least one combustion chamber with the engine having coolant passages at least around the one combustion chamber. A heat exchange device has internal flow passages and is fluidly connected to the coolant passages. A pump is provided for circulating coolant through the passages and the heat exchange device for removing heat from at least around the combustion chamber, the coolant passages, heat exchange device, the pump being selected to cause nucleate boiling at least around the combustion chamber. A sensor is provided for indicating the presence of nucleate boiling of coolant in the system. At least one chamber is connected to the cooling system with the chamber having a dividing wall displaceable within the chamber to vary the volume of the chamber connected to the cooling system. A device is provided for variably displacing the dividing wall in response to control by the sensor to maintain the pressure in the system at a level permitting controlled nucleate boiling to increase the heat flux from at least around the combustion chamber.

BRIEF DESCRIPTION OF THE DRAWINGS

FIG. 1 shows a schematic view of a power system having an internal combustion engine with a coolant system embodying the present invention.

DETAILED DESCRIPTION OF THE INVENTION

Referring to FIG. 1, there is shown a power system 10 having an internal combustion engine, generally indicated by reference character 12. Internal combustion engine 12 may be one of a number of types of engines in terms of combustion process but is usually a liquid cooled internal combustion engine 12 having a block 14 and a head 16, both of which have internal surfaces exposed to a combustion chamber of variable volume provided by reciprocating pistons all connected to an output crankshaft to provide a rotary power output. Details of the internal portions of block 14 and head 16 are not shown to simplify the understanding of the present invention. Engine 12 has an exhaust manifold 18 receiving products of combustion and delivering them through an exhaust conduit 20 to a turbine 22 of a turbocharger 24 and ultimately to an exhaust conduit 23 leading to ambient. The turbine 22 drives a compressor 26 through a common shaft 28. The compressor 26 receives ambient air from an inlet 30 and delivers it through inlet line 32, usually past an aftercooler 34, and line 36 to an intake manifold 38.

The engine 12 is an air breathing, fuel consuming internal combustion engine in which a hydrocarbon based fuel is burned to provide a rotary power output. Many other features such as exhaust gas recirculation (EGR) and exhaust after-treatment may be employed as appropriate. However, these are not shown to further simplify the discussion of the present invention.

The engine 12, as stated previously, is a liquid cooled engine in which internal coolant passages within the block 14 and head 16 carry away the waste heat generated from the combustion process. The coolant is pressurized by a pump 40 through passage 42 to the engine 12 where it is circulated through appropriately sized and positioned passages to carry heat away from engine 12. Pump 40 is usually mechanically driven by engine 12. The coolant, with the additional heat input passes through line 44 to a heat exchanger 46 to dissipate the increase in heat. Heat exchange device 46, in usual fashion, may be a radiator of the liquid to air type in which the coolant passing through line 44 traverses multiple internal flow passages (not shown). In heat exchange device 46, ambient air is forced over the exterior of the passages, usually with extra heat exchange surfaces to carry away the heat to the ambient air. A return line 48 is connected from the outlet of heat exchange device 46 and feeds the inlet to pump 40.

The heat exchange device 46 may have a top tank (not shown) but, in addition, it has a reservoir 50 exposed to ambient pressure at 52 and having a cap 54 for replenishment of fluid. A high pressure cap 58 on heat exchange device 46 is connected to a line 58 extending from heat exchange device 46 to reservoir 50.

In accordance with the present invention, a chamber 60 is connected to the engine cooling system, at least to the coolant passages in the head 16, by a line 62. Chamber 60 has a variable volume chamber 64 connected to line 62. A wall 68 is displaceable within chamber 60 to vary the volume of chamber 64. Although the wall 68 may be rigid in form, it is preferable that it be a flexible diaphragm be employed. These flexible diaphragms are found in plumbing systems to maintain pressure levels and expansion and contraction capability to accommodate variations in system volume, because of temperature changes. Tanks incorporating flexible diaphragms are widely commercially available at reasonable cost.

The displaceable wall 68 forms, in part, a second variable volume chamber 67 having a volume inversely proportional to the volume of chamber 64. A line 78 leads from chamber 67 to a three-way valve 76 and to a line 72 connected to the air discharge line 32 from compressor 26. A check valve 74 permits flow only from the compressor 26 to the valve 76. Three-way valve 76 has a first position in which air passes from line 72 into chamber 67 and a second position in which air flows from chamber 67 to the atmosphere via line 80. Thus valve 76 controls the increase and decrease of air pressure in chamber 67 and accordingly the increase and decrease of pressure in chamber 64 and the coolant system of engine 12.

Although the source of pressure is shown as being from the compressor 26, it should be apparent that other sources of pressure may be employed to displace wall 68 to control coolant system pressures. Furthermore, separate valve functions may be used in place of the three-way valve 76.

Valve 76, as herein shown, is electrically actuatable by an ECM 66 via a signal line 82. A sensor 90 is connected to ECM 66 via a line 92. Sensor 70 preferably is connected to the head 16 of engine 12 so as to determine conditions closest to the engine combustion chambers. Sensor 90 is a sensor enabling the detection of nucleate boiling. This may be accomplished by making sensor 90 a pressure sensor that senses differential pressure versus differential time or another words the rate of change of pressure versus time. This would determine that the conditions are approaching nucleate boiling and can determine effectively whether the conditions have gone beyond nucleate boiling to macro-boiling or an out of control situation. Another, alternative measurement would be to provide sensor 90 in the form of a temperature sensor sensing the differential temperature versus differential time. Again this is an indicator of the coolant system going beyond nucleate boiling and into the macro-boiling conditions.

Still other sensor forms for 90 may take the form of a bubble detector 94 such as an optical device calibrated to respond to bubbles of a given size or a sonic sensor also calibrated to determine the size of bubbles. Bubble detector 94 is connected to ECM 66 via line 96.

The component parts of the engine 12 and more specifically the coolant passages within engine 12 and heat exchanger 46 are selected with due regard to the duty cycle of the engine so that the engine 12, in combination with its cooling system operates, in the region of and promotes nucleate boiling. In order for the engine condition to be controlled within a relatively tight range of nucleate boiling, the sensor 90 and/or sensor 94 determine(s) the presence of nucleate boiling and sends a signal to ECM 66 which in turn actuates valve 76 to pressurize the cooling system within engine 12 to maintain nucleate boiling conditions by increasing pressure on the displaceable wall 68. The variable chamber 64 does not have to have a high volume variation since it is pressurizing a liquid within rigid confines so that brief actuation is sufficient to raise the pressures to appropriate levels. A typical pressure for maintaining nucleate boiling is between three and four bars. In order to control the upper level of pressure, valve 76 responds to signals from the ECM 66 via line 82 to release pressure to line 80 to ambient pressure. The valve 76 preferably is electrically controlled and a fast responding valve so that a tight control may be maintained over the conditions that produce nucleate boiling.

The ultimate effect of such a cooling system is to enable higher system operating temperatures up to 150 C and a more compact engine envelope because of a higher potential heat flux of waste heat from the combustion process. Cooling system pressure is controlled in such a manner as to prevent uncontrolled boiling under high heat flux engine operating conditions. This is done through an increase in cooling system pressure to suppress bubble formation. With the present invention, conventional engines can run considerably higher coolant temperatures than they do today, without significantly increasing peak internal metal temperatures. At lower engine heat flux such as lighter load operational conditions, system pressures can be reduced to levels below today's engines, in order to induce nucleate boiling. The wide range of pressure control with the present invention produces lower metal temperatures throughout the operating envelope than would be possible otherwise, for a given capacity cooling system. This is preferably accomplished with relatively low cost and simplified components.

Having described the preferred embodiment, it will become apparent that various modifications can be made without departing from the scope of the invention as defined in the accompanying claims.

The invention claimed is:

1. A cooling system for a liquid cooled internal combustion engine having at least one combustion chamber, said system comprising:

coolant passages formed at least around the combustion chamber for said engine;

a heat exchange device fluidly connected to said passages for dissipating heat from at least around the combustion chamber;

a pump for circulating coolant through said passages and said heat exchanger, said coolant passages, heat exchange device and pump being selected to cause nucleate boiling at least around said combustion chamber;

a sensor for indicating the presence of nucleate boiling in said system, at least one chamber connected to said cooling system, said chamber having a dividing wall movable within said chamber to vary the volume of the chamber connected to said cooling system, and a device for variably displacing said dividing wall in response to control by said sensor to maintain the pressure in said system at a level permitting controlled nucleate boiling to increase the heat flux from at least around the combustion chamber, wherein said sensor is a bubble detector.

2. The cooling system as claimed in claim 1, wherein said sensor is selected from one of an optical sensor and an ultrasonic sensor.

3. The cooling system as claimed in claim 1, wherein said engine has a head portion, at least a portion of which is in contact with the engine combustion chamber and said sensor is connected to said head for sensing nucleate boiling.

4. The cooling system as claimed in claim 1, wherein said dividing wall is a flexible diaphragm.

5. The cooling system as claimed in claim 1, wherein said device pressurizes the face of the dividing wall opposite to said variable volume chamber connected to said cooling system.

6. The cooling system as claimed in claim 5, wherein said device is a valve connected to a source of air pressure.

7. The cooling system as claimed in claim 6, wherein said engine includes a turbo supercharger and the source of pressure is the compressor discharge.

8. The cooling system as claimed in claim 7, including a check valve permitting air flow only from the compressor discharge to said valve.

9. The cooling system as claimed in claim 6, wherein said valve is a three-way valve permitting flow from said source of air pressure in a first position to said opposite face of said dividing wall and in a second position permitting flow from said opposite face of said dividing wall to atmosphere.

10. A power system comprising:

a liquid cooled internal combustion engine having at least one combustion chamber, said engine having coolant passages at least around said one combustion chamber;

a heat exchange device having internal flow passages and fluidly connected to said coolant passages;

a pump for circulating coolant through said passages and said heat exchange device for removing heat from at least around said combustion chamber, said coolant passages, heat exchange device and pump being selected to cause nucleate boiling at least around said combustion chamber;

a sensor for indicating the presence of nucleate boiling of said coolant in said system;

at least one chamber connected to said cooling system, said chamber having a dividing wall movable within said chamber to vary the volume of the chamber connected to said cooling system, and a device for variably displacing said dividing wall in response to control by said sensor to maintain the pressure in said system at a level permitting controlled nucleate boiling to increase the heat flux from at least around the combustion chamber.

11. The power system as claimed in claim 10, wherein said sensor is a pressure sensor indicating the change in pressure over change in time.

12. The power system as claimed in claim 10, wherein said sensor is a temperature sensor indicating the change in temperature over the change in time.

13. The power system as claimed in claim 10, wherein said sensor is a bubble detector selected from one of an optical sensor and an ultrasonic sensor.

14. The power system as claimed in claim 10, wherein said engine has a head at least a portion of which is directly connected to said combustion chamber and said sensor is connected to said head.

15. The power system as claimed in claim 10, wherein said dividing wall is a flexible diaphragm.

16. The power system as claimed in claim 10, wherein said device pressurizes the face of the dividing wall opposite to said variable volume chamber connected to said cooling system.

17. The power system as claimed in claim 16, wherein said device is a valve connected to a source of air pressure.

18. The power system as claimed in claim 17, wherein said engine includes a turbo supercharger and the source of pressure is the compressor discharge.

19. The power system as claimed in claim 17, including a check valve permitting air flow only from the compressor discharge to said valve.

20. The power system as claimed in claim 17, wherein said valve is a three-way valve permitting flow from said source of air pressure in a first position to said opposite face of said dividing wall and in a second position permitting flow from said opposite face of said dividing wall to atmosphere.

* * * * *